US006828871B2

(12) United States Patent
Shimizu

(10) Patent No.: US 6,828,871 B2
(45) Date of Patent: Dec. 7, 2004

(54) SMALL-LOSS, LARGE-RETURN-LOSS NONRECIPROCAL CIRCUIT DEVICE

(75) Inventor: Yuichi Shimizu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 103 days.

(21) Appl. No.: 10/386,857

(22) Filed: Mar. 12, 2003

(65) Prior Publication Data

US 2003/0174027 A1 Sep. 18, 2003

(30) Foreign Application Priority Data

Mar. 14, 2002 (JP) ..... 2002-070024

(51) Int. Cl.[7] ..... H01P 1/32
(52) U.S. Cl. ..... 333/1.1; 333/24.2
(58) Field of Search ..... 333/1.1, 24.2; H01P 1/32, 1/38

(56) References Cited

U.S. PATENT DOCUMENTS 3,573,665 A * 4/1971 Knerr ..... 333/1.1
6,549,086 B2 * 4/2003 Kawanami ..... 333/1.1
6,603,369 B2 * 8/2003 Ohira et al. ..... 333/1.1
6,657,511 B2 * 12/2003 Dejima ..... 333/1.1
6,724,276 B2 * 4/2004 Kawanami et al. ..... 333/1.1

FOREIGN PATENT DOCUMENTS

JP 2001-185912 7/2001

* cited by examiner

*Primary Examiner*—Tuan T. Lam
*Assistant Examiner*—Hiep Nguyen
(74) *Attorney, Agent, or Firm*—Brinks Hofer Gilson & Lione

(57) ABSTRACT

A planar magnetic core is disposed in a DC magnetic field, and the top surface thereof is perpendicular to the direction of the DC magnetic field. Three central conductors are placed on the top surface of the magnetic core so that they overlap with each other at regular intervals substantially at the center of the top surface of the magnetic core. One end of each of the central conductors is used as an input/output terminal, and the other ends thereof are used as ground terminals. The inductance per unit length of the central conductor from the central portion to the ground terminal is set to be smaller than that from the central portion to the input/output terminal.

5 Claims, 5 Drawing Sheets

SMALL-LOSS, LARGE-RETURN-LOSS NONRECIPROCAL CIRCUIT DEVICE

BACKGROUND OF THE INVENTION

1. Field of the Invention

The present invention relates to nonreciprocal circuit devices utilizing the Faraday effect.

2. Description of the Related Art

The main portion of a known nonreciprocal circuit device is shown in FIG. 8. A disc-like magnetic core 21 formed of ferrite, such as yttrium-iron-garnet (YIG), is disposed in a DC magnetic field generated by a permanent magnet (not shown), and the top surface of the magnetic core 21 is perpendicular to the direction of the DC magnetic field. Three central conductors 22, 23, and 24 are placed on the top surface of the magnetic core 21, and are held so that they overlap with each other at regular intervals (120°) substantially at the center of the magnetic core 21 while being insulated from each other. The lengths of the three central conductors 22, 23, and 24 are substantially the same, and thus, the inductances are also substantially equal.

The central conductors 22, 23, and 24 include two strip-like conductor portions 22*a* and 22*b*, 23*a* and 23*b*, and 24*a* and 24*b*, respectively, opposing each other. One end of the central conductor 22 serves as an input/output terminal 22*c*, and the other end thereof is used as a ground terminal 22*c*; one end of the central conductor 23 serves as an input/output terminal 23*c*, and the other end thereof is used as a ground terminal 23*c*; and one end of the central conductor 24 serves as an input/output terminal 24*c*, and the other end thereof is used as a ground terminal 24*d*. The input/output terminals 22*c*, 23*c*, and 24*c* are connected to corresponding circuits (not shown), and are grounded via matching termination capacitors 25, 26, and 27, respectively, which have equal capacitances. The ground terminals 22*d*, 23*d*, and 24*d* are connected to corresponding grounded casings (not shown).

The central conductor 22 and the termination capacitor 25 form a resonance circuit. Similarly, the central conductor 23 and the termination capacitor 26 form a resonance circuit, and the central conductor 24 and the termination capacitor 27 form a resonance circuit. The resonant frequencies of the resonance circuits are set by the corresponding termination capacitors 25, 26, and 27 so that they become equal to the frequency of an input signal. The central conductors 22, 23, and 24 are coupled to each other, and then, a double-tuned circuit is formed, for example, between the input/output terminals 22*c* and 23*c*. Similarly, double-tuned circuits are also formed between the input/output terminals 23*c* and 24*c* and between the input/output terminals 24*c* and 22*c*.

In the above-described configuration, due to the Faraday effect, the following phenomenon occurs. A signal input into the input/output terminal 22*c* of the central conductor 22 is output to the input/output terminal 23*c* of the central conductor 23, which is displaced clockwise from the input/output terminal 22*c* by 120°. A signal input into the input/output terminal 23*c* of the central conductor 23 is output to the input/output terminal 24*c* of the central conductor 24, which is displaced clockwise from the input/output terminal 23*c* by 120°. A signal input into the input/output terminal 24*c* of the central conductor 24 is output to the input/output terminal 22*c* of the central conductor 22.

The central conductors 22, 23, and 24 overlap with each other on the magnetic core 21 such that they are extremely close to each other. Accordingly, the above-described double-tuned circuits are closely coupled to each other, and the transmission characteristic, for example, from the input/output terminal 22*c* to the input/output terminal 23*c* exhibits a double peak response, as shown in FIG. 9, and the insertion loss becomes large at frequency F0. The return loss indicating the input impedance or the output impedance at the input/output terminal also exhibits a double peak response, and becomes low (small) at frequency F0. For allowing the double-tuned circuits to critically coupled to each other, the central conductors can be separated by vertically displacing them from each other. It is difficult, however, to physically change the positional relationship among the central conductors in the vertical direction.

SUMMARY OF THE INVENTION

Accordingly, it is an object of the present invention to decrease loss at a signal frequency and to increase return loss at input/output terminals by ensuring a required transmission band for input/output signals.

In order to achieve the above object, the present invention provides a nonreciprocal circuit device including: a planar magnetic core disposed in a DC magnetic field, a top surface of the magnetic core being perpendicular to the direction of the DC magnetic field; and three central conductors disposed to overlap with each other substantially at a central portion of the top surface of the magnetic core, one end of each of the three central conductors being used as an input/output terminal, and the other end thereof being used as a ground terminal. The inductance per unit length from the central portion to the ground terminal of each of the three central conductors is set to be smaller than that from the central portion to the input/output terminal of each of the three central conductors.

With this configuration, the inductance from the central portion to the ground terminal becomes relatively smaller than that from the central portion to the input/output terminal. Accordingly, the transmission characteristic between the input/output terminals exhibits substantially a single peak response rather than a double peak response, thereby decreasing the transmission loss. The return loss also exhibits substantially a single peak response, and the impedance matching with another circuit connected to the nonreciprocal circuit device can be provided.

Each of the three central conductors may include two strip-like conductor portions opposing each other with an equal spacing therebetween, and a short-circuiting strip for connecting the two strip-like conductor portions may be provided between the central portion and the ground terminal. With this arrangement, the inductance from the central portion to the ground terminal becomes relatively smaller than that from the central portion to the input/output terminal.

Alternatively, each of the three central conductors may include two strip-like conductor portions opposing each other, and the width of each of the strip-like conductor portions from the central portion to the ground terminal may be set to be greater than that from the central portion to the input/output terminal. With this arrangement, the inductance from the central portion to the ground terminal becomes relatively smaller than that from the central portion to the input/output terminal. Additionally, a greater width of the strip-like conductor portions toward the ground terminal decreases the current loss.

Alternatively, each of the three central conductors may include two strip-like conductor portions opposing each other, and the spacing between the two strip-like conductor portions from the central portion to the ground terminal may be set to be greater than that from the central portion to the input/output terminal. With this arrangement, the inductance from the central portion to the ground terminal becomes relatively smaller than that from the central portion to the input/output terminal.

In the above-mentioned modification, the width of each of the strip-like conductor portions from the central portion to the ground terminal may be set to be greater than that from the central portion to the input/output terminal. With this arrangement, the inductance from the central portion to the ground terminal relatively becomes much smaller than that from the central portion to the input/output terminal. Additionally, a greater width of the strip-like conductor portions toward the ground terminal decreases the current loss.

DESCRIPTION OF THE PREFERRED EMBODIMENTS

Figure 1:
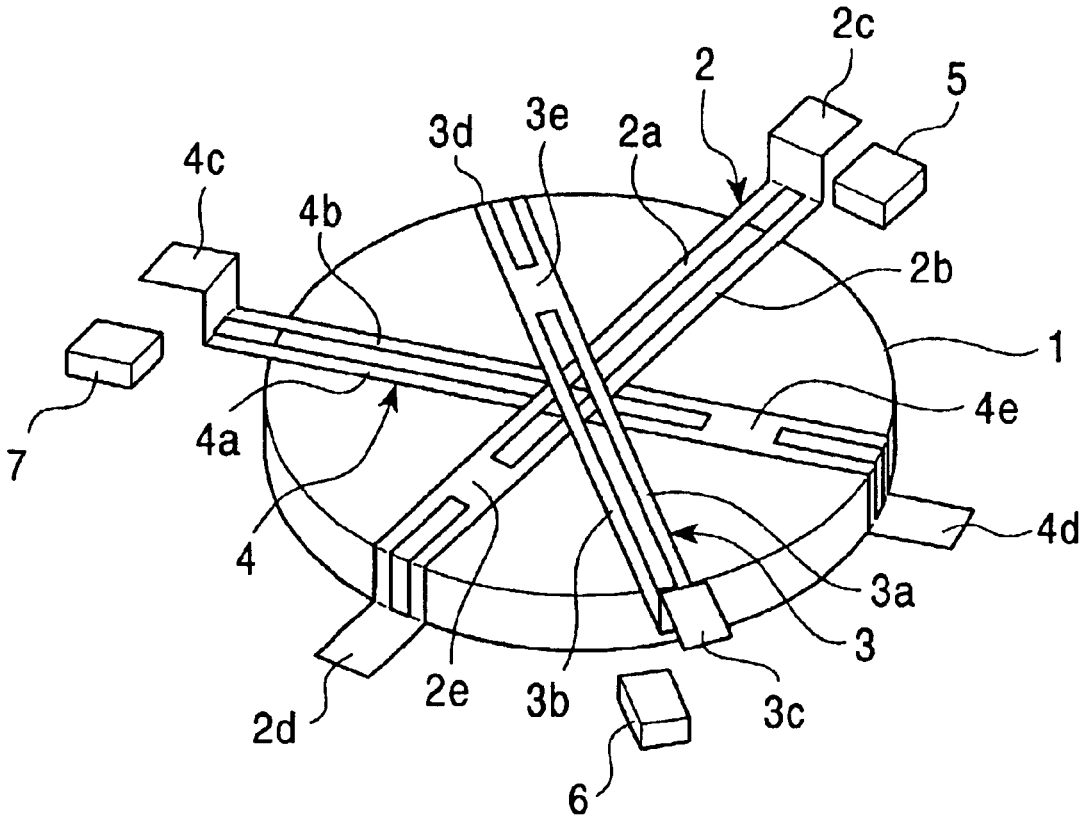
FIG. 1 is an exploded perspective view illustrating the main portion of a nonreciprocal circuit device according to a first embodiment of the present invention.

A first embodiment of the present invention is described below with reference to FIG. 1. A disc-like magnetic core 1 formed of a ferrite, such as YIG, is disposed in a DC magnetic field generated by a permanent magnet (not shown), and the top surface of the magnetic core 1 is perpendicular to the direction of the DC magnetic field. Three central conductors 2, 3, and 4 are placed on the top surface of the magnetic core 1, and are held so that they overlap with each other at regular intervals (120°) substantially at the center of the top surface of the magnetic core 1 while being insulated from each other.

The central conductors 2, 3, and 4 include two strip-like conductor portions 2*a* and 2*b*, 3*a* and 3*b*, and 4*a* and 4*b*, respectively, having the same width and opposing each other at an equal spacing therebetween. One end of the central conductor 2 serves as an input/output terminal 2*c*, and the other end thereof is used as a ground terminal 2*d*; one end of the central conductor 3 serves as an input/output terminal 3*c*, and the other end thereof is used as a ground terminal 3*d*; and one end of the central conductor 4 serves as an input/output terminal 4*c*, and the other end thereof is used as a ground terminal 4*d*. The input/output terminals 2*c*, 3*c*, and 4*c* are connected to corresponding circuits (not shown), and are grounded via matching capacitors 5, 6, and 7, respectively, which have equal capacitances. The ground terminals 2*d*, 3*d*, and 4*d* are connected to corresponding grounded casings (not shown).

The central conductor 2 and the matching capacitor 5 form a resonance circuit. Similarly, the central conductor 3 and the matching capacitor 6 form a resonance circuit, and the central conductor 4 and the matching capacitor 7 form a resonance circuit. The resonant frequencies are set by the corresponding matching capacitors 5, 6, and 7 so that they become equal to the frequency of an input signal. The central conductors 2, 3, and 4 are coupled to each other, and then, a double-tuned circuit is formed, for example, between the input/output terminals 2*c* and 3*c*. Likewise, double-tuned circuits are also formed between the input/output terminals 3*c* and 4*c* and between the input/output terminals 4*c* and 2*c*.

In the above-described configuration, due to the Faraday effect, the following phenomenon occurs. A signal input into the input/output terminal 2*c* of the central conductor 2 is output to the input/output terminal 3*c* of the central conductor 3, which is displaced clockwise from the input/output terminal 2*c* by 120°. A signal input into the input/output terminal 3*c* of the central conductor 3 is output to the input/output terminal 4*c* of the central conductor 4, which is displaced clockwise from the input/output terminal 3*c* by 120°. A signal input into the input/output terminal 4*c* of the central conductor 4 is output to the input/output terminal 2*c* of the central conductor 2.

It is now assumed that, since the central conductors 2, 3, and 4 have substantially the same length, and the lengths from the overlapping central portions to the input/output terminals 2*c*, 3*c*, and 4*c* of the conductors 2, 3, and 4 are equal to each other, inductances L1 thereof become substantially equal. It is also assumed that, since the lengths from the overlapping central portions to the ground terminals 2*d*, 3*d*, and 4*d* of the conductors 2, 3, and 4 are substantially equal, inductances L3 thereof become equal, and inductances L2 of the overlapping central portions also become equal.

Figure 2:
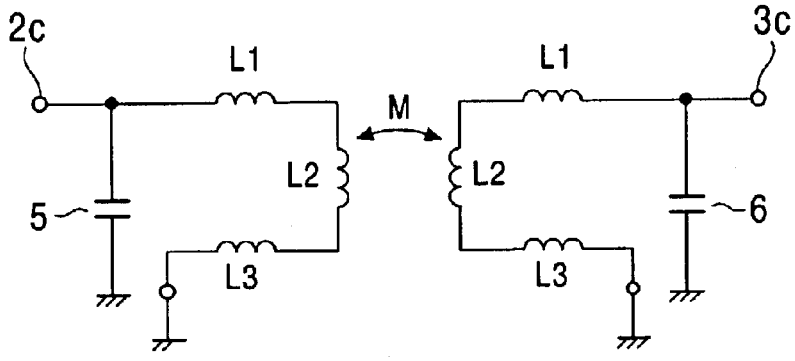
FIG. 2 is an equivalent circuit diagram of a non-reciprocal circuit device of the present invention.

The configuration between the input/output terminals 2*c* and 3*c* can be represented by the equivalent circuit shown in FIG. 2. In FIG. 2, inductance M is the mutual inductance resulting from the coupling of inductances L2.

Figure 3:
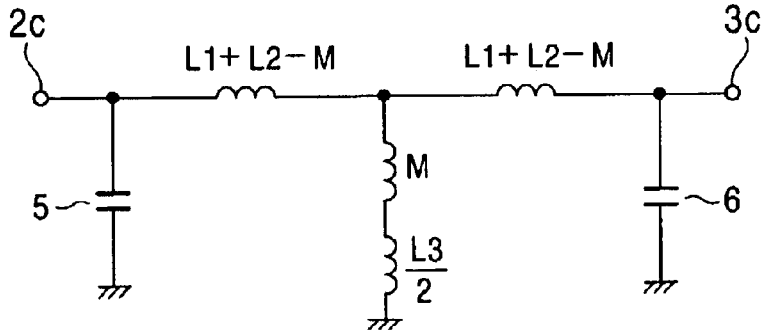
FIG. 3 is an equivalent circuit diagram of a non-reciprocal circuit device of the present invention.
Figure 4:
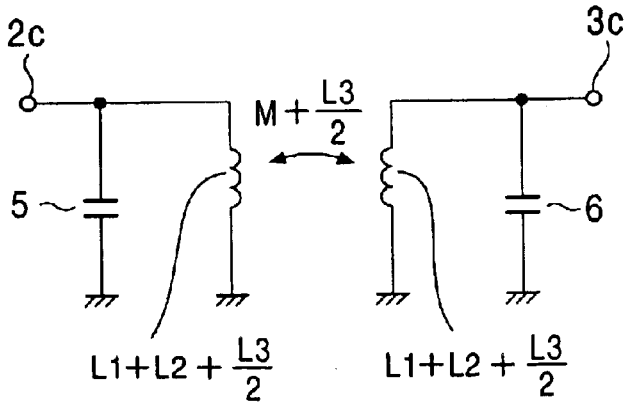
FIG. 4 is an equivalent circuit diagram of a non-reciprocal circuit device of the present invention.

The equivalent circuit shown in FIG. 2 can be modified into the equivalent circuit shown in FIG. 3 or 4. Accordingly, when K represents the coupling coefficient of inductances L1+L2+L3/2, the coupling index k (different from the coupling coefficient K) of the double-tuned circuit shown in FIG. 4 is expressed by equation (1):

$$k = KQ = \frac{M + \frac{L3}{2}}{L1 + L2 + \frac{L3}{2}} Q \tag{1}$$

where M indicates the mutual inductance resulting from the coupling of inductances L2 shown in FIG. 2 (when the coupling coefficient is indicated by K1); and Q is the Q factor of the tuned circuits determined by a signal source impedance and a load impedance (having the same value as the signal source impedance) connected to the input/output terminals 2*c* and 3*c*.

The coupling index k represents the transmission characteristic of a double-tuned circuit, and the coupling index k becomes greater than 1 when the transmission characteristic exhibits a double peak response. Accordingly, when focusing on the coupling coefficient K in equation 1, the numerator M is indicated by expression: M=K1×L2, and considering that K1 is 1 or smaller, and that L2 is definitely smaller than L3, i.e., L2<L3, because of the structure of the central conductors, M can be expressed by M<L3/2. The denominator of equation (1) can be expressed as L1+L2>L3/2. Accordingly, the coupling coefficient K can be simplified into equation (2).

$$K = \frac{L3}{2(L1 + L2)} \tag{2}$$

Equation 2 shows that the coupling index k can be made smaller by increasing inductances L1 and L2 and by decreasing inductance L3.

Figure 5:
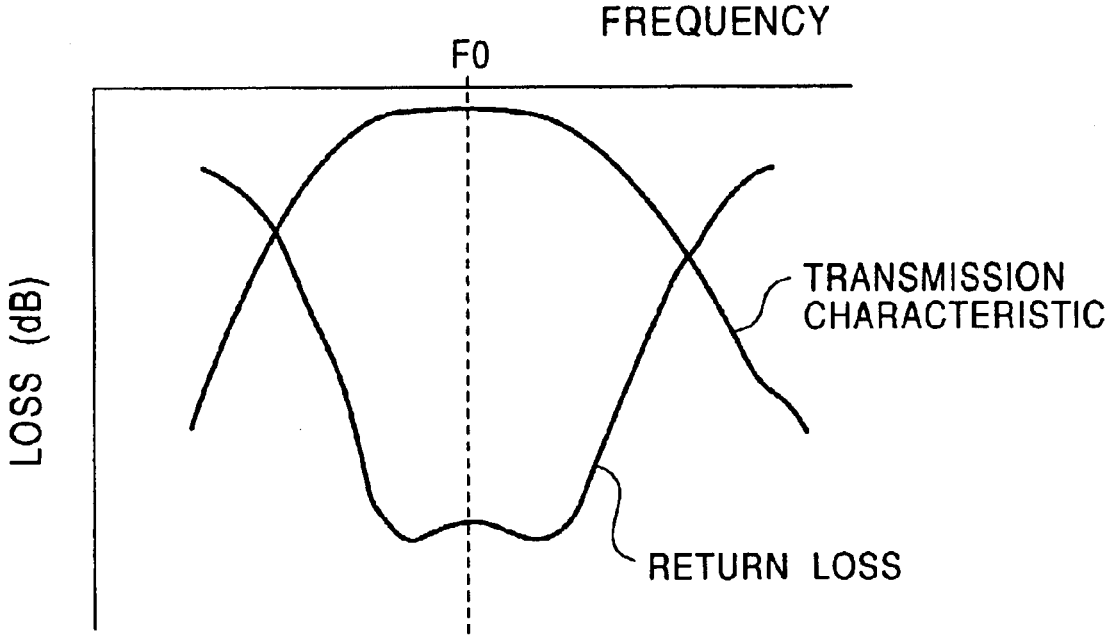
FIG. 5 is a diagram illustrating a transmission characteristic of a nonreciprocal circuit device of the present invention.

Accordingly, a short-circuiting strip 3*e* for partially connecting the two conductor portions 2*a* and 2*b* is provided between the overlapping central portion and the ground terminal 2*d* of the central conductor 2. Similarly, short-circuiting strips 3*e* and 4*e* are provided for the other central conductors 3 and 4, respectively. With this arrangement, the average inductance per unit length from the overlapping central portion to the ground terminal 2*d*, 3*d*, or 4*d* becomes smaller than that from the overlapping central portion to the input/output terminal 2*c*, 3*c*, or 4*c*, thereby decreasing the coupling index k. Thus, as shown in FIG. 5, the transmission characteristic exhibits substantially a single peak response, the loss at signal frequency F0 is decreased, and the return loss indicating the input impedance or the output impedance at the input/output terminal also distinctively exhibits a single peak response.

Figure 6:
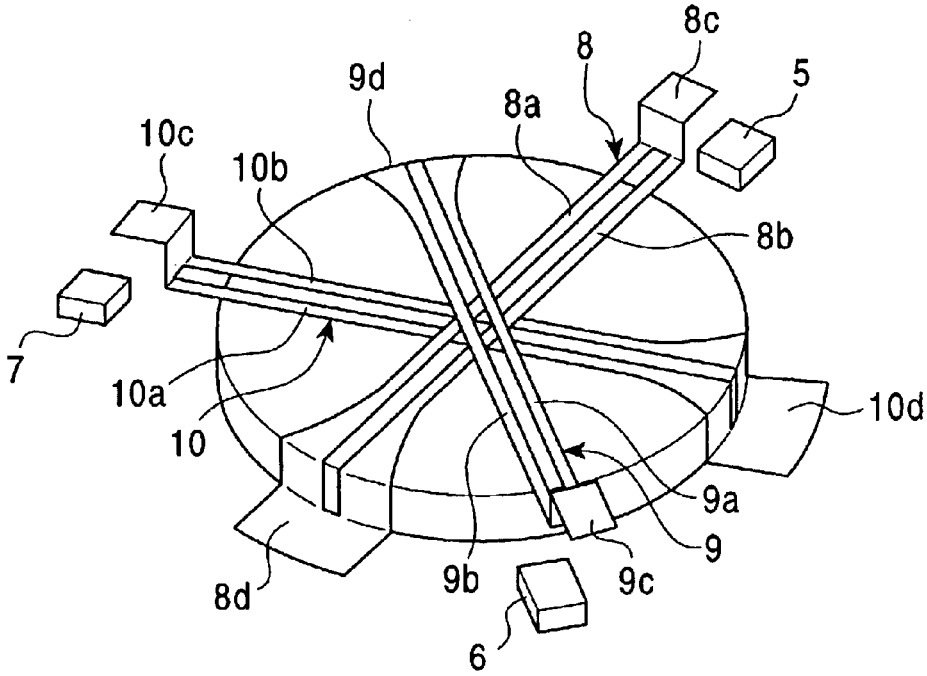
FIG. 6 is an exploded perspective view illustrating the main portion of a nonreciprocal circuit device according to a second embodiment of the present invention.

FIG. 6 illustrates a second embodiment of the present invention. In FIG. 6, central conductors 8, 9, and 10 are formed of two opposing conductor portions 8*a* and 8*b*, 9*a* and 9*b*, and 10*a* and 10*b*, respectively. One end of the central conductor 8 serves as an input/output terminal 8*c*, and the other terminal thereof is used as a ground terminal 8*d*; one end of the central conductor 9 serves as an input/output terminal 9*c*, and the other end thereof is used as a ground terminal 9*d*; and one end of the central conductor 10 serves as an input/output terminal 10*c*, and the other end thereof is used as a ground terminal 10*d*. The input/output terminals 8*c*, 9*c*, and 10*c* are connected to corresponding circuits (not shown), and are grounded via the matching capacitors 5, 6, and 7, respectively, which have equal capacitances. The ground terminals 8*d*, 9*d*, and 10*d* are connected to corresponding grounded casings (not shown).

As in the first embodiment shown in FIG. 1, the central conductors 8, 9 and 10 are held so that they overlap with each other at regular intervals (120°) substantially at the center of the top surface of the magnetic core 1 while being insulted from each other.

The two conductor portions 8*a* and 8*b*, 9*a* and 9*b*, or 10*a* and 10*b* oppose each other with an equal spacing, and the width thereof becomes greater toward the ground terminal 8*d*, 9*d*, or 10*d*. With this configuration, the average inductance per unit length from the overlapping portion to the ground terminal 8*d*, 9*d*, or 10*d* of the central conductor 8, 9, or 10 becomes smaller than that from the overlapping central portion to the input/output terminal 8*c*, 9*c*, or 10*c*.

Accordingly, the equivalent circuit of the double-tuned circuit formed between the input/output terminals 8*c* and 9*c* can also be indicated as shown in FIG. 4, and thus, the coupling index k expressed by equation (1) becomes smaller. In the second embodiment, the object of the present invention can be achieved without providing short-circuiting strips, which are provided in the first embodiment.

Figure 7:
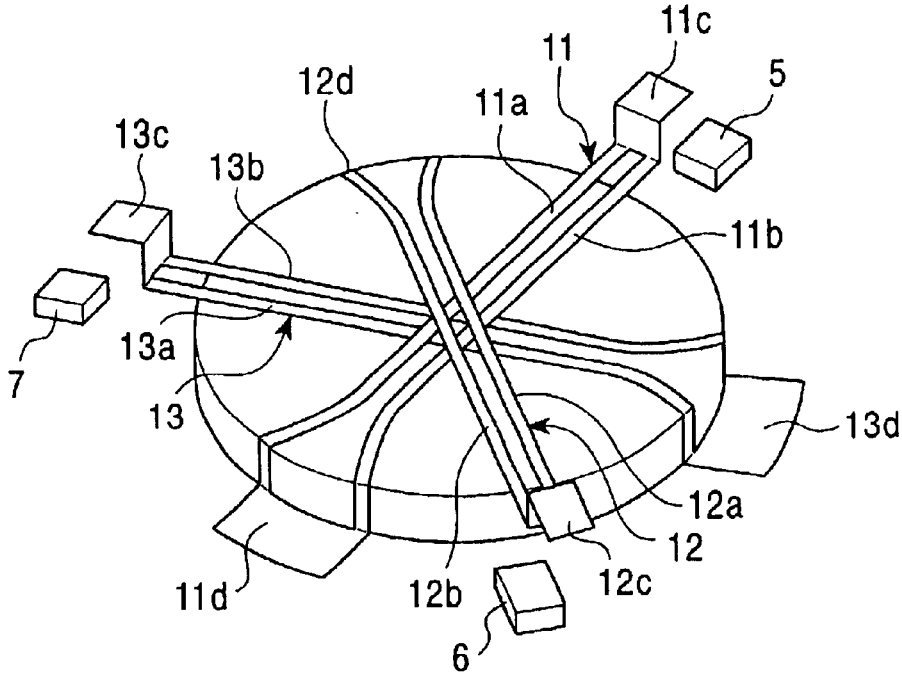
FIG. 7 is an exploded perspective view illustrating the main portion of a nonreciprocal circuit device according to a third embodiment of the present invention.
Figure 8:
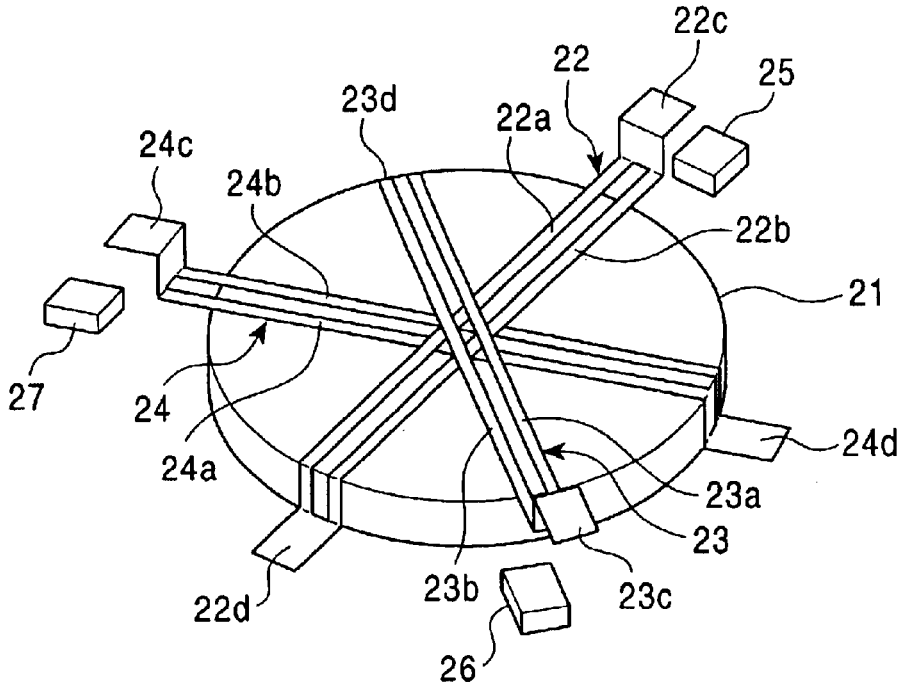
FIG. 8 PRIOR ART
FIG. 8 is an exploded perspective view illustrating the main portion of a known nonreciprocal circuit device.
Figure 9:
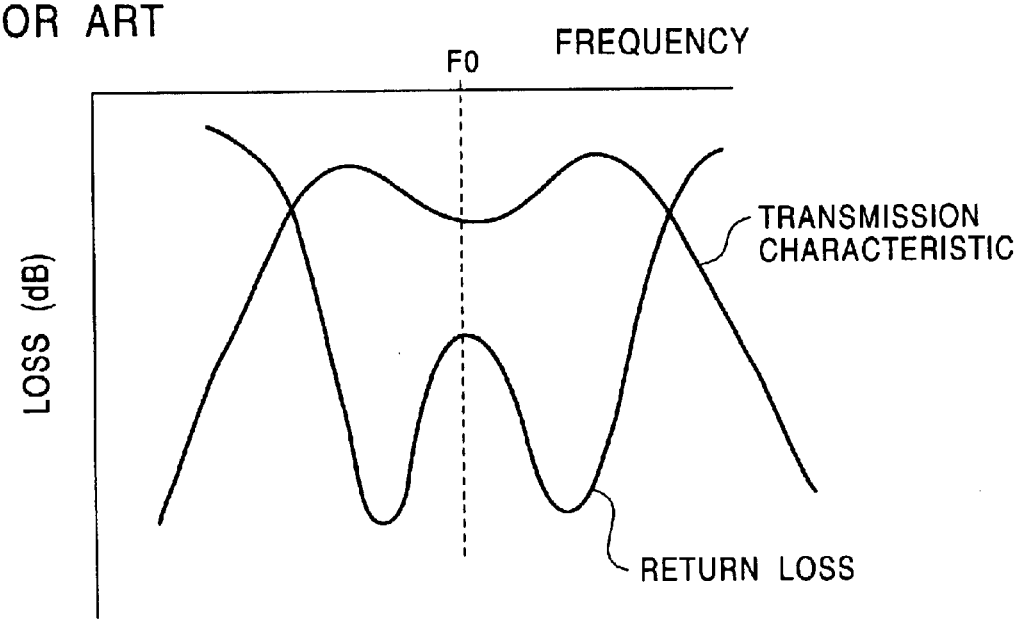
FIG. 9 PRIOR ART
FIG. 9 is a diagram illustrating a transmission characteristic of a known nonreciprocal circuit device.

FIG. 7 illustrates a third embodiment of the present invention. In FIG. 7, central conductors 11, 12, and 13 are formed of two opposing conductor portions 11*a* and 11*b*, 12*a* and 12*b*, and 13*a* and 13*c*, respectively. One end of the central conductor 11 serves as an input/output terminal 11*c*, and the other end thereof is used as a ground terminal 1*d*; one end of the central conductor 12 serves as an input/output terminal 12*c*, and the other end thereof is used as a ground terminal 12*d*; and one end of the central conductor 13 serves as an input/output terminal 13*c*, and the other end thereof is used as a ground terminal 13*d*. The input/output terminals 11*c*, 12*c*, and 13*c* are connected to corresponding circuits (not shown), and are grounded via matching capacitors 5, 6, and 7, respectively, which have equal capacitances. The ground terminals lid, 12*d*, and 13*d* are connected to corresponding grounded casings (not shown).

As in the first embodiment shown in FIG. 1, the central conductors 11, 12, and 13 are held so that they overlap with each other at regular intervals (120°) substantially at the center of the top surface of the magnetic core 1 while being insulated from each other.

The two conductor portions 11*a* and 11*b*, 12*a* and 12*b*, or 13*a* and 13*b* oppose each other with an equal spacing, and the width thereof is the same and the spacing therebetween becomes greater toward the ground terminal 11*d*, 12*d*, or 13*d*. With this configuration, the coupling force between the two conductor portions 11*a* and 11*b*, 12*a* and 12*b*, or 13*a* and 13*b* becomes weaker toward the ground terminal 11*d*, 12*d*, or 13*d*, and thus, the inductance becomes smaller. Accordingly, the average inductance per unit length from the overlapping central portions to the ground terminals 11*d*, 12*d*, and 13*d* of the central conductors 11, 12, and 13 becomes smaller than that from the central portions to the input/output terminals 11*c*, 12*c*, and 13*c*.

In the third embodiment, therefore, the double-tuned circuit formed, for example, between the input/output terminals 11*c* and 12*c* can be indicated as shown in FIG. 4, and thus, the coupling index k expressed by equation (1) is decreased.

The configuration of the second embodiment may be applied to the third embodiment. That is, the spacing between the two conductor portions 11*a* and 11*b*, 12*a* and 12*b*, or 13*a* and 13*b* is increased toward the ground terminal 11*d*, 12*d*, or 13*d*, and also, the width thereof is increased toward the ground terminal 11*d*, 12*d*, or 13*d*. With this configuration, the average inductance from the overlapping central portions to the ground terminals 11*d*, 12*d*, and 13*d* of the central conductors 11, 12, and 13 becomes much smaller than that from the central portions to the input/output terminals 11*c*, 12*c*, and 13*c*. Thus, a greater advantage can be exhibited by this modification.

What is claimed is:

1. A nonreciprocal circuit device comprising:

a planar magnetic core disposed in a DC magnetic field, a top surface of said magnetic core being perpendicular to a direction of the DC magnetic field; and three central conductors disposed to overlap with each other substantially at a central portion of the top surface of said magnetic core, one end of each of said three central conductors being used as an input/output terminal, and the other end thereof being used as a ground terminal, wherein an inductance per unit length from a central portion to the ground terminal of each of said three central conductors is set to be smaller than an inductance per unit length from the central portion to the input/output terminal of each of said three central conductors.

2. A nonreciprocal circuit device according to claim 1, wherein each of said three central conductors comprises two strip-like conductor portions opposing each other with an equal spacing therebetween, and a short-circuiting strip for connecting the two strip-like conductor portions is provided between the central portion and the ground terminal.

3. A nonreciprocal circuit device according to claim 1, wherein each of said three central conductors comprises two strip-like conductor portions opposing each other, and a width of each of the strip-like conductor portions from the central portion to the ground terminal is set to be greater than a width of each of the strip-like conductor portions from the central portion to the input/output terminal.

4. A nonreciprocal circuit device according to claim 1, wherein each of said three central conductors comprises two strip-like conductor portions opposing each other, and spacing between the two strip-like conductor portions from the central portion to the ground terminal is set to be greater than spacing between the two strip-like conductor portions from the central portion to the input/output terminal.

5. A nonreciprocal circuit device according to claim 4, wherein a width of each of the strip-like conductor portions from the central portion to the ground terminal is set to be greater than a width of each of the strip-like conductor portions from the central portion to the input/output terminal.

* * * * *